US009655496B2

(12) United States Patent
Baldwin et al.

(10) Patent No.: US 9,655,496 B2
(45) Date of Patent: May 23, 2017

(54) DISHWASHER WITH SPRAYER

(71) Applicant: Whirlpool Corporation, Benton Harbor, MI (US)

(72) Inventors: Mark W. Baldwin, Saint Joseph, MI (US); Mike S. Hemry, Stevensville, MI (US); Barry E. Tuller, Stevensville, MI (US); Ameresh B. Viswanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 761 days.

(21) Appl. No.: 13/705,200

(22) Filed: Dec. 5, 2012

(65) Prior Publication Data

US 2014/0069470 A1 Mar. 13, 2014

Related U.S. Application Data

(63) Continuation of application No. 13/613,751, filed on Sep. 13, 2012.

(51) Int. Cl.
*A47L 15/14* (2006.01)
*A47L 15/42* (2006.01)
(Continued)

(52) U.S. Cl.
CPC ..... *A47L 15/4246* (2013.01); *A47L 15/16* (2013.01); *A47L 15/22* (2013.01); *A47L 15/4202* (2013.01); *A47L 15/4214* (2013.01); *A47L 15/4219* (2013.01); *A47L 15/4204* (2013.01); *A47L 15/4282* (2013.01); *A47L 15/4285* (2013.01)

(58) Field of Classification Search
CPC .... A47L 15/16; A47L 15/428; A47L 15/4214; A47L 15/4246; A47L 15/22; A47L 15/4202; A47L 15/4219; A47L 15/4285; A47L 15/486
See application file for complete search history.

(56) References Cited

U.S. PATENT DOCUMENTS 2,044,524 A * 6/1936 Caise ..... 134/103.1
3,708,120 A * 1/1973 Camprubi ..... A47L 15/16 134/56 D (Continued)

FOREIGN PATENT DOCUMENTS

WO WO 2005060813 A1 * 7/2005
WO WO 2010073185 A1 * 7/2010 ..... A47L 15/486

OTHER PUBLICATIONS

Machine English Translation of WO 2005/060813 A1 (Jerg et al. Jul. 2005).*

*Primary Examiner* — Joseph L Perrin
*Assistant Examiner* — Irina Graf
(74) *Attorney, Agent, or Firm* — McGarry Bair PC

(57) ABSTRACT

A dishwasher for treating dishes according to at least one automatic cycle of operation and including a tub having a bottom wall for at least partially defining a treating chamber in which dishes may be received for treatment, at least one sprayer provided on the bottom wall, and having at least one opening through which liquid is emitted into the treating chamber, and a recirculation circuit fluidly coupling the treating chamber to the at least one sprayer such that liquid emitted into the treating chamber may be directed back to the sprayer for recirculation.

16 Claims, 11 Drawing Sheets

(51) Int. Cl.
*A47L 15/16* (2006.01)
*A47L 15/22* (2006.01)

(56) References Cited

U.S. PATENT DOCUMENTS

| | | | | |
|---|---|---|---|---|
| 5,131,419 | A * | 7/1992 | Roberts | 134/50 |
| 5,331,986 | A * | 7/1994 | Lim et al. | 134/88 |
| 5,655,556 | A * | 8/1997 | Guerrera | A47L 15/23 134/176 |
| 5,673,714 | A * | 10/1997 | Campagnolo | A47L 15/23 134/176 |
| 7,350,527 | B2 * | 4/2008 | Gurubatham et al. | 134/104.1 |
| 7,594,513 | B2 | 9/2009 | Vanderroest et al. | |
| 8,038,802 | B1 * | 10/2011 | Tuller | A47L 15/0031 134/10 |
| 2010/0154841 | A1 * | 6/2010 | Fountain et al. | 134/104.2 |
| 2011/0146714 | A1 * | 6/2011 | Fountain | A47L 15/4206 134/10 |
| 2011/0214702 | A1 * | 9/2011 | Brown-West et al. | 134/198 |

* cited by examiner

DISHWASHER WITH SPRAYER

CROSS-REFERENCE TO RELATED APPLICATIONS

This application is a continuation-in-part of U.S. patent application Ser. No. 13/613,751, filed Sep. 13, 2012, which is incorporated herein by reference in its entirety.

BACKGROUND OF THE INVENTION

Contemporary automatic dishwashers for use in a typical household include a tub for receiving soiled dishes to be cleaned. A spray system and a recirculation system may be provided for re-circulating liquid throughout the tub to remove soils from the dishes. The dishwasher may have a controller that implements a number of pre-programmed cycles of operation to wash dishes contained in the tub.

BRIEF DESCRIPTION OF THE INVENTION

In one aspect, the disclosure relates to a dishwasher for treating dishes according to at least one automatic cycle of operation, including a tub comprising a lowermost bottom wall for at least partially defining a treating chamber in which dishes may be received for treatment, at least one sprayer having a body with at least a portion of the body directly provided on the lowermost bottom wall and where the body includes multiple openings on an upper surface of the body through which liquid is emitted into the treating chamber, a recirculation circuit, with a recirculation inlet located in the lowermost bottom wall, fluidly coupling the treating chamber to the at least one sprayer, such that liquid emitted into the treating chamber from the at least one sprayer may be returned to the recirculation circuit through the recirculation inlet and directed back to the sprayer for recirculation, a sump located exteriorly of the treating chamber and having a housing that is fluidly coupled to the recirculation circuit and separated from the treating chamber by a conduit such that it cannot be accessed by the treating chamber, a heater located exteriorly of the sump and thermally coupled to the sump, an air supply system conduit thermally coupled to the heater and configured to provide air to the treating chamber, and a filter located within the housing of the sump to filter liquid passing through the sump. A placement of the heater, the filter, and the sump exteriorly of the treating chamber is configured to free the lowermost bottom wall of the tub for placement of the body of the at least one sprayer on the lowermost bottom wall; and wherein the heater is configured to heat at least one of liquid passing through the recirculation circuit or air provided to the treating chamber.

DESCRIPTION OF EMBODIMENTS OF THE INVENTION

Figure 1:
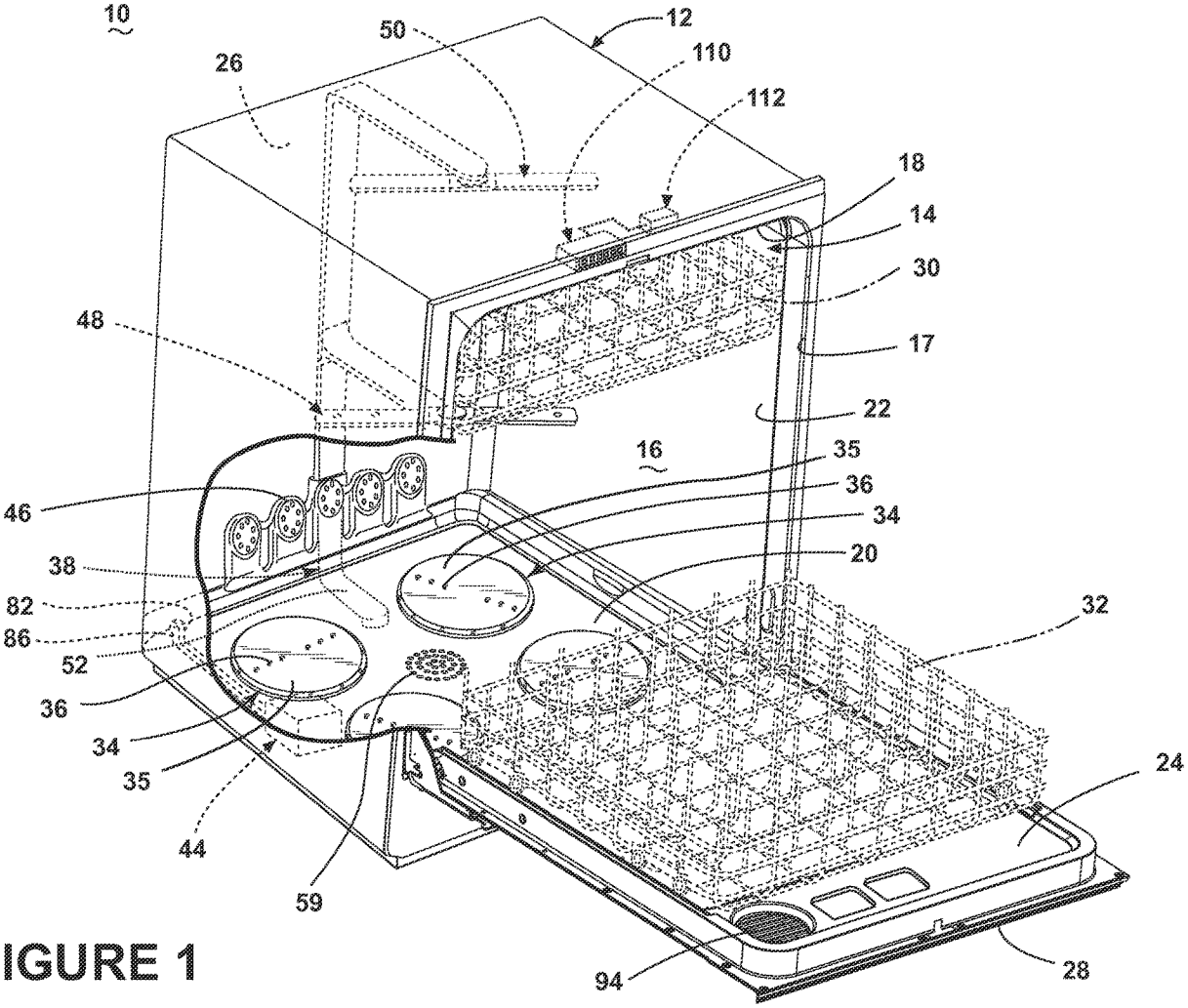
FIG. 1 is a perspective view of a dishwasher in accordance with a first embodiment of the invention.

Referring to FIG. 1, a first embodiment of the invention is illustrated as a dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention.

The cabinet 12 encloses a tub 14 at least partially defining a treating chamber 16 for holding dishes for washing according to a cycle of operation and defining an access opening 17. The tub 14 has spaced top and bottom walls 18 and 20, spaced sidewalls 22, a front wall 24, and a rear wall 26. In this configuration, the walls 18, 20, 22, 24, and 26 collectively define the treating chamber 16 for treating or washing dishes. The front wall 24 may be at least partially defined by a door 28 of the dishwasher 10, which may be pivotally attached to the dishwasher 10 for providing accessibility to the treating chamber 16 through the access opening 17 for loading and unloading dishes or other washable items. More specifically, the door 28 may be configured to selectively open and close the access opening 17.

Dish holders in the form of upper and lower dish racks 30, 32 are located within the treating chamber 16 and receive dishes for washing. The upper and lower racks 30, 32 may be mounted for slidable movement in and out of the treating chamber 16 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While the present invention is described in terms of a conventional dishwashing unit as illustrated in FIG. 1, it could also be implemented in other types of dishwashing units such as in-sink dishwashers or drawer dishwashers including drawer dishwashers having multiple compartments.

A disk sprayer 34 may be provided on the bottom wall 20 of the tub 14. In the illustrated example, multiple disk sprayers 34 have been included in the dishwasher 10. More specifically, four disk sprayers 34 have been provided on the bottom wall 20. The four disk sprayers 34 may be arranged in any suitable manner on the bottom wall 20. By way of example, the four disk sprayers are illustrated as being arranged one-per-quadrant relative to the bottom wall 20. Further, while each of the four disk sprayers 34 have been illustrated as being all the same size it is contemplated that the four disk sprayers 34 may be different sizes. While four disk sprayers 34 have been illustrated, it will be understood that any number of disk sprayers 34 may be used and that the disk sprayers may occupy any amount of the total area of the bottom wall 20. The size, area, and location of the disk sprayers 34 may be such that the disk sprayers 34 may provide best coverage and wash performance for the dishes in the load.

Each of the disk sprayers 34 includes a body 35 and at least one opening 36 through which liquid may be emitted into the treating chamber 16. Multiple openings 36 have been illustrated and it is contemplated that any number of the openings 36 may spray liquid into the treating chamber. More specifically, the disk sprayers 34 may be configured to spray a flow of liquid from openings 36 over a portion of the interior of the wash tub 14. The openings 36 have been illustrated on both a top of the disk sprayer 34 and on a peripheral edge of the disk sprayer 34. In this manner, liquid may be sprayed both upwards and outwards. A first wash zone may be defined by the spray field emitted by the disk sprayers 34 into the treating chamber 16. The spray from the disk sprayers 34 is sprayed into the wash tub 14 in typically upward fashion to wash dishes located in the lower dish rack 32.

The disk sprayer 34 may take any suitable form including that the body 35 of the rotatable disk sprayer 34 may be rotatable relative to the bottom wall 20 of the tub 14. Alternatively, the disk sprayer 34 may be a fixed disk sprayer 34 that is fixed relative to the bottom wall 20 of the tub 14. Such a fixed disk sprayer 34 may have a body 35 which is integrally formed with the bottom wall 20 of the tub 14. Alternatively, the fixed disk sprayer 34 may be separately formed and mounted to the bottom wall 20 of the tub 14. Regardless of whether the disk sprayer 34 is rotatable or fixed, the disk sprayer 34 may be spaced above the bottom wall 20. Alternatively, the disk sprayer 34 may not be substantially spaced above the bottom wall 20. If the sprayer 34 is rotatable, the sprayer 34 may be positioned above the bottom wall 20 only an amount necessary to permit rotation without interference with the bottom wall 20. Alternatively, when the sprayer 34 is rotatable, it is permissible for the sprayer 34 to be partially sunken into the bottom wall 20. Alternatively, the disk sprayer may be flush with the bottom wall 20 or inset in a portion of the bottom wall 20. If the disk sprayers 34 are spaced above the bottom wall 20 they may optionally also provide a liquid spray downwardly onto a lower portion of the treating chamber 16, but for purposes of simplification, this will not be illustrated or described herein. It is also contemplated that the disk sprayers 34 may be spaced from the bottom wall 20 such that additional components, such as a heater, may be located between the disk sprayers 34 and the bottom wall 20. If the disk sprayers are rotatable, it is contemplated that they need not all rotate in the same direction. Further, it is contemplated that for multiple disk sprayers that some may be fixed and others may rotate.

Figure 2:
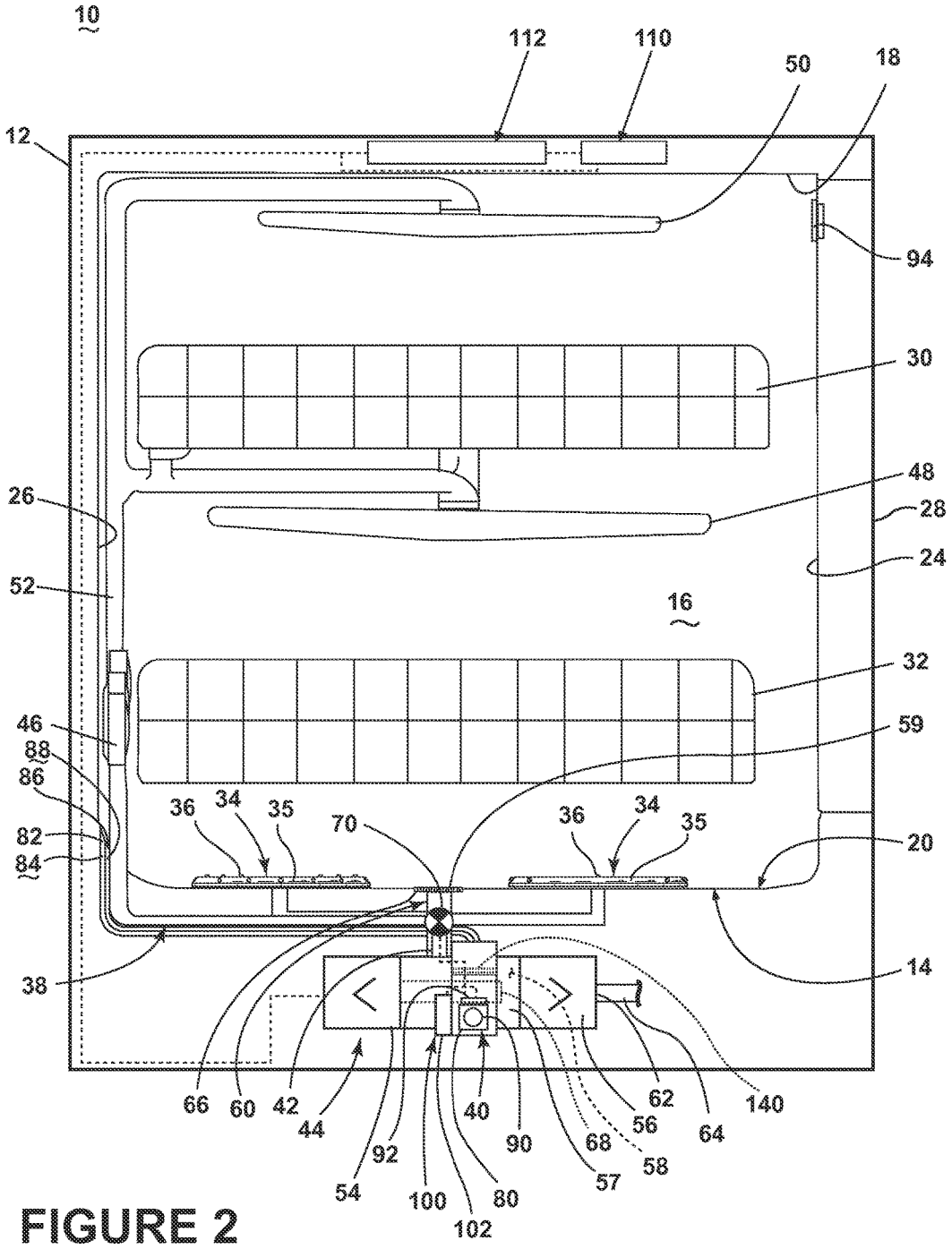
FIG. 2 is a partial schematic cross-sectional view of the dishwasher shown in FIG. 1 and illustrating a recirculation system and air supply system.

Referring to FIG. 2, the major systems of the dishwasher 10 and their interrelationship may be seen. For example, a liquid recirculation system 38 is provided for spraying liquid within the treating chamber 16 to treat any dishes located therein and an air supply system 40 is provided for supplying air to the treating chamber 16 for aiding in the drying of the dishes. A recirculation circuit 42 fluidly coupling the treating chamber 16 to the disk sprayers 34 may be included in the recirculation system 38 such that liquid emitted into the treating chamber 16 may be directed back to the disk sprayers 34 for recirculation. A remote sump and filter unit 44 that is physically remote or spaced from the treating chamber 16 is operably coupled to the recirculation circuit 42 of the recirculation system 38 and the air supply system 40 may also be included. Among other things, the remote sump and filter unit 44 may provide pumping and filtering for the liquid recirculation system 38, a heating function for the both the liquid recirculation system 38 and the air supply system 40, and a draining function.

One or more additional sprayers for spraying liquid within the treating chamber 16 may also be included in the recirculation system 38. These one or more additional sprayers may be included in the recirculation circuit 42. As illustrated, there are three additional sprayers: a spray assembly 46, a mid-level spray assembly 48, and an upper spray assembly 50, which may be supplied liquid from a supply tube 52 in the recirculation circuit 42. The spray assembly 46 is illustrated as being located adjacent the lower rack 32 toward the rear of the treating chamber 16. The spray assembly 46 is illustrated as including a horizontally oriented distribution header or spray manifold having a plurality of nozzles. The spray assembly 46 may not be limited to this position; rather, the spray assembly 46 could be located in virtually any part of the treating chamber 16. Alternatively, the spray assembly 46 could be positioned underneath the lower rack 32, adjacent or beneath the disk sprayers 34. Such a spray manifold is set forth in detail in U.S. Pat. No. 7,594,513, issued Sep. 29, 2009, and titled "Multiple Wash Zone Dishwasher," which is incorporated herein by reference in its entirety. The spray assembly 46 may be configured to spray a flow of treating liquid in a generally lateral direction, over a portion of the interior of the treating chamber 16. The spray may be typically directed to treat dishes located in the lower rack 32. A second wash zone may be defined by the spray field emitted by the spray assembly 46 into the treating chamber 16. When both the disk sprayers 34 and the spray assembly 46 emit spray fields the first and second zones may intersect.

The mid-level spray arm assembly 48 is positioned between the upper dish rack 30 and the lower dish rack 32. The mid-level spray assembly 48 may also be configured to rotate in the dishwasher 10 and spray a flow of liquid in a generally upward direction, over a portion of the interior of the wash tub 14. In this case, the spray from the mid-level spray arm assembly 48 is directed to dishes in the upper dish rack 30 to define a third spray zone. In contrast, the upper spray arm assembly 50 is positioned above the upper dish rack 30 and generally directs a spray of liquid in a generally downward direction to define a fourth spray zone that helps wash dishes on both upper and lower dish racks 30, 32.

The remote sump and filter unit 44 may include a wash or recirculation pump 54 and a drain pump 56, which are fluidly coupled to a housing 57 defining a sump 58, where liquid sprayed into the wash tub 14 will collect due to gravity. In this manner, the sump 58 is fluidly coupled to the recirculation circuit 42. As illustrated, the housing 57 is physically separate from the wash tub 14 and provides a mounting structure for the recirculation pump 54 and drain pump 56.

A recirculation inlet opening 59 may be located in the bottom wall 20 and may be fluidly coupled to a recirculation conduit 60 leading to the housing 57. In the illustrated example, the recirculation inlet opening 59 is located in the bottom wall 20 between the disk sprayers 34. It will be understood that the recirculation inlet opening 59 may be located anywhere in the bottom wall 20. For example, if the disk sprayers 34 are arranged differently, including if there is a single disk sprayer 34, then the recirculation inlet opening need not be located between the disk sprayers 34. The recirculation conduit 60 provides a path for the liquid in the treating chamber 16 to travel to the sump 58. As illustrated, the recirculation pump 54 fluidly couples the sump 58 to the supply tube 52 to effect a supplying of the liquid from the sump 58 to the sprayers. As illustrated, the drain pump 56 fluidly couples to a drain pump outlet 62 to effect a supplying of liquid from the sump 58 to a household drain 64.

It is contemplated that multiple supply tubes 52 may be included within the dishwasher 10 to form portions of the recirculation circuit 42. Liquid may be selectively supplied to a subset of all of the sprayers and/or simultaneously to all of the sprayers. The recirculation conduit 60, sump 58, recirculation pump 54, disk sprayers 34, spray assemblies 46-50, and supply tube(s) 52 collectively form the recirculation circuit 42 in the liquid recirculation system 38. It will be understood that the recirculation circuit 42 includes multiple recirculation flow paths. Further, one or more valves may be provided with the recirculation circuit 42 to control the flow of liquid within the dishwasher 10. For example, a liquid diverter 70 has been included in the dishwasher 10 to control the flow of liquid to the sprayers from the recirculation pump 54. The liquid diverter 70 is provided within the recirculation circuit 42 and is operable to select between at least two of the multiple flow paths for inclusion in the recirculation circuit 42. In this manner, the liquid diverter 70 may direct liquid from the recirculation pump 54 to include in the recirculation flow path at least one of the sprayers in the dishwasher 10. This includes that the liquid diverter 70 may be operable to select at least one of the four illustrated disk sprayers 34.

A filter may be located somewhere within the recirculation circuit 42 such that soil and foreign objects may be filtered from the liquid. As an example, a coarse screen 66 has been illustrated as being located at the recirculation inlet opening 59 such that soil and debris may be filtered from the liquid as it travels from the recirculation inlet opening 59 in the bottom wall 20 to the sump 58. The coarse screen 66 may be a strainer, which may be employed to retain larger soil particles but allows smaller particles to pass through. Further, a fine screen filter 68 has been illustrated in FIG. 2 as being located within the housing 57 between the recirculation conduit 60 and the recirculation pump 54.

The recirculation pump 54 may be fluidly coupled to the recirculation circuit 42 such that it draws liquid in through the recirculation conduit 60 and sump 58 and delivers it to one or more of the disk sprayers 34 or spray assemblies 46-50 through the supply tube(s) 52 depending on the operation of the liquid diverter 70. The liquid is sprayed back into the treating chamber 16 through the disk sprayers 34 and/or spray assemblies 46-50 and drains back to the sump 58 where the process may be repeated.

The drain pump 56 may also be fluidly coupled to the housing 57. The drain pump 56 may be adapted to draw liquid from the housing 57 and to pump the liquid through a drain pump outlet 62 to a household drain 64. As illustrated, the dishwasher 10 includes a recirculation pump 54 and a drain pump 56. Alternatively, it is possible for the two pumps to be replaced by a single pump, which may be operated to supply to either the household drain 64 or to the recirculation system.

The air supply system 40 may include a fan or blower 80, an air supply conduit 82 having an outlet 84 and an air return conduit 86 having an inlet 88. The blower 80 may be fluidly coupled with the air supply conduit 82 to supply air to the treating chamber 16 from the blower 80 as well as being fluidly coupled to the air return conduit 86 to draw air from the treating chamber 16. Thus, the air supply conduit 82 may be configured to provide air to the treating chamber 16 while the air return conduit 86 may be configured to remove air from the treating chamber 16. It should be noted that a closure, such as a valve, flap or other means (not shown) may be used to close off the fluid connection between the air supply conduit 82 and the air return conduit 86 and the wash tub 14 during certain portions of the cycle of operation so that liquid does not enter the air supply conduit 82 and the air return conduit 86.

The air supply system may also include an inlet 90 located below the bottom wall 20 such that air exterior to the tub 14, i.e., "ambient air", may be provided to the treating chamber 16. In this manner the blower 80 includes a first inlet open to air in the dishwasher 10, which is the air return conduit inlet 88 and a second inlet open to ambient air, which is the inlet 90. The blower 80 may include a selectively positionable blower shutter 92, which may control a ratio of air from the air return conduit inlet 88 and the inlet 90 to the treating chamber 16. The blower shutter 92 may be controlled such that the ratio of air from the inlet 90 and air from the air return conduit 86 may be controlled. In this manner, the blower 80 may be fluidly coupled to the inlet 90, as well as the air supply conduit 82 and the air return conduit 86 and the blower shutter 92 may control the ratio of the recirculated air and the ambient air provided to the treating chamber through the air supply conduit 82.

Further, the air supply system 40 may include an outlet fluidly open to ambient air. An example of such an outlet has been illustrated as a vent 94, which may exhaust the supplied air from the treating chamber 16. The vent 94 may be fluidly coupled to an outlet duct (not shown), which vents into the interior of the door 28, allowing air to escape through the various openings in the door 28.

A drive system 100 having a single motor 102 has also been illustrated and may be operably coupled to the liquid diverter 70 and the blower shutter 92 to control the position of the liquid diverter 70 and the position of the blower shutter 92. The drive system 100 may independently control the position of the liquid diverter 70 and the position of the blower shutter 92. Alternatively, the control of the position of the liquid diverter 70 and the position of the blower shutter 92 by the drive system 100 may be linked or related in some manner. Alternatively, the control of the position of the liquid diverter 70 and the position of the blower shutter 92 may be controlled separately. Such a drive system 100 and a potential liquid diverter 70 are set forth in detail in U.S. patent application Ser. No. 13/486,038, filed Jun. 1, 2012, and titled "Dishwasher with Unitary Wash Module," which is incorporated herein by reference in its entirety. Yet another example, of a suitable liquid diverter 70 may include a rotatable diverter disk such as set forth in detail in U.S. patent application Ser. No. 12/908,915, filed Oct. 21, 2010, and titled "Dishwasher with Controlled Rotation of Lower Spray Arm," which is incorporated herein by reference in its entirety.

A control panel or user interface 110 provided on the dishwasher 10 and coupled to a controller 112 may be used to select a cycle of operation. The user interface 110 may be provided on the cabinet 12 or on the outer panel of the door 28 and can include operational controls such as dials, lights, switches, and displays enabling a user to input commands to the controller 112 and receive information about the selected cycle of operation. The dishwasher 10 may further include other conventional components such as additional valves, a dispensing system for dispensing treating chemistries or rinse aids, spray arms or nozzles, etc.; however, these components are not germane to the present invention and will not be described further herein.

Figure 3:
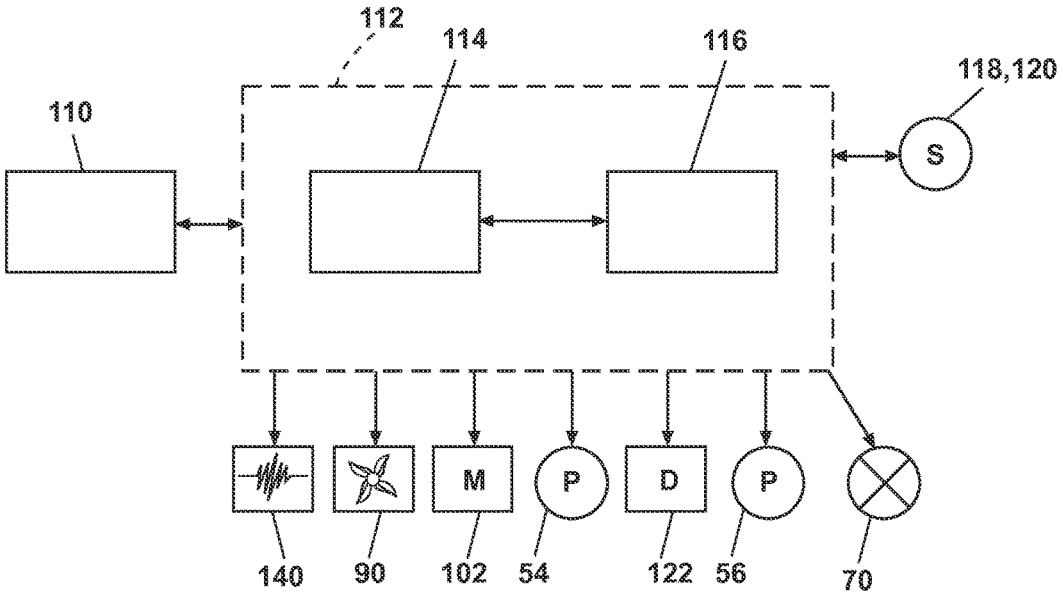
FIG. 3 is a schematic view of a control system of the dishwasher of FIG. 1.

As illustrated in FIG. 3, the controller 112 may be provided with a memory 114 and a central processing unit (CPU) 116. The memory 114 may be used for storing control software that may be executed by the CPU 116 in completing a cycle of operation using the dishwasher 10 and any additional software. For example, the memory 114 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 112 may be operably coupled with one or more components of the dishwasher 10 for communicating with and controlling the operation of the components to complete a cycle of operation. For example, the controller 112 may be coupled with the recirculation pump 54 for circulation of liquid in the wash tub 14 and the drain pump 56 for drainage of liquid in the wash tub 14. The controller 112 may also be operably coupled with the blower 80 and the blower shutter 92 to provide air into the wash tub 14.

Further, the controller 112 may also be coupled with one or more temperature sensors 118, which are known in the art and not shown for simplicity, such that the controller 112 may control the duration of the steps of the cycle of operation based upon the temperature detected. The controller 112 may also receive inputs from one or more other optional sensors 120, which are known in the art and not shown for simplicity. Non-limiting examples of optional sensors 120 that may be communicably coupled with the controller 112 include a moisture sensor, a door sensor, a detergent and rinse aid presence/type sensor(s), and a position sensor. The controller 112 may also be coupled to a dispenser 122, which may dispense a detergent during the wash step of the cycle of operation or a rinse aid during the rinse step of the cycle of operation.

Figure 4:
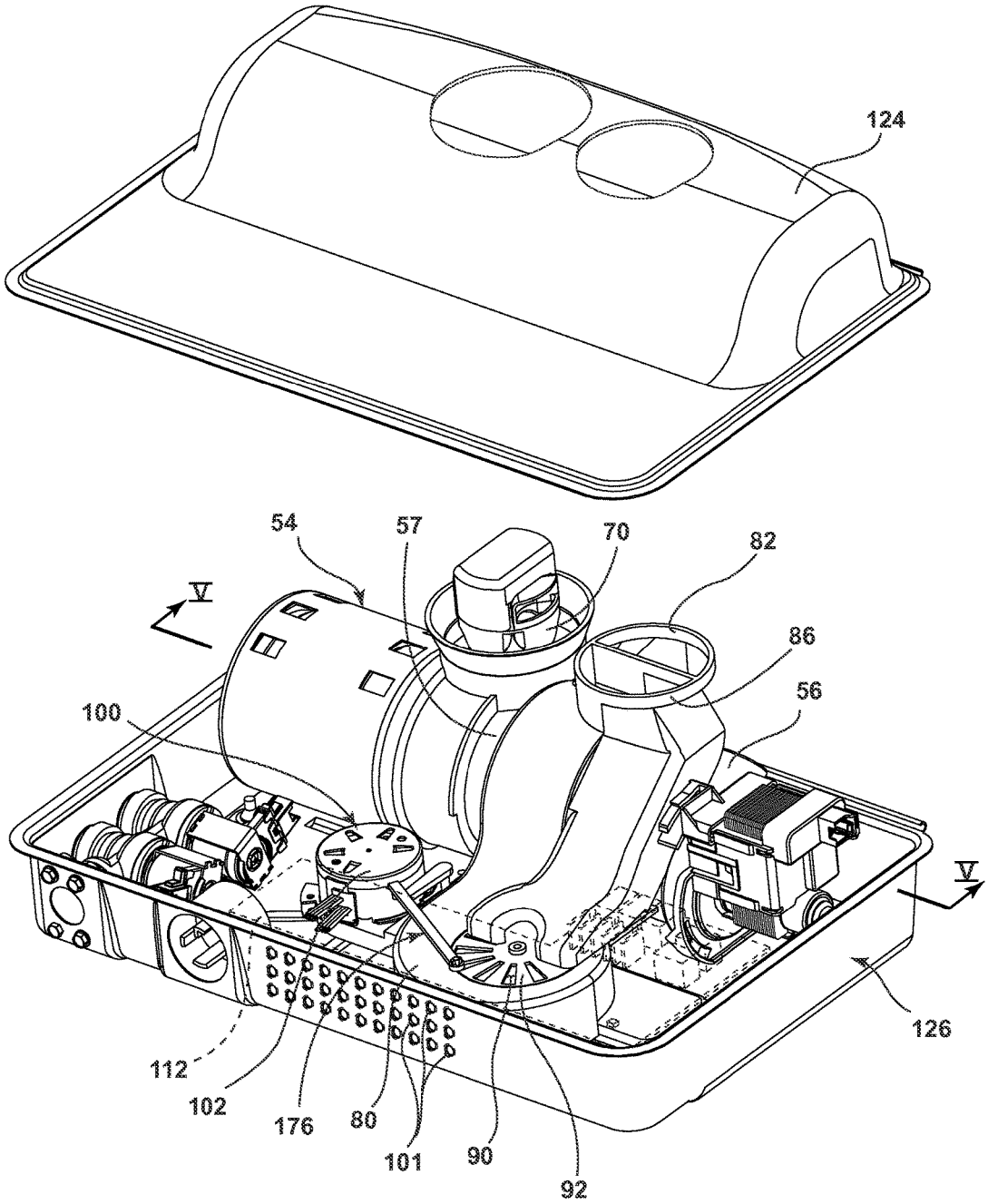
FIG. 4 is a perspective view of one embodiment of a remote sump and filter unit and its couplings to the recirculation system and air supply system illustrated in FIG. 2.

FIG. 4 illustrates a perspective view of one embodiment of the remote sump and filter unit 44. A cover 124 of the remote sump and filter unit 44 has been exploded from the remainder of the remote sump and filter unit 44 for clarity. The cover 124 may be mounted to a bottom 126 containing the remote sump and filter unit 44 in any suitable manner. The bottom 126 may include louvers or openings 101 to allow ambient air into the container formed by the bottom 126 and the cover 124. The remote sump and filter unit 44 has a drain pump 56 and recirculation pump 54 mounted to the housing 57. Portions of the air supply system 40 wrap around the housing 57. It will be understood that only a portion of both the air supply conduit 82 and the air return conduit 86 are illustrated.

Figure 5:
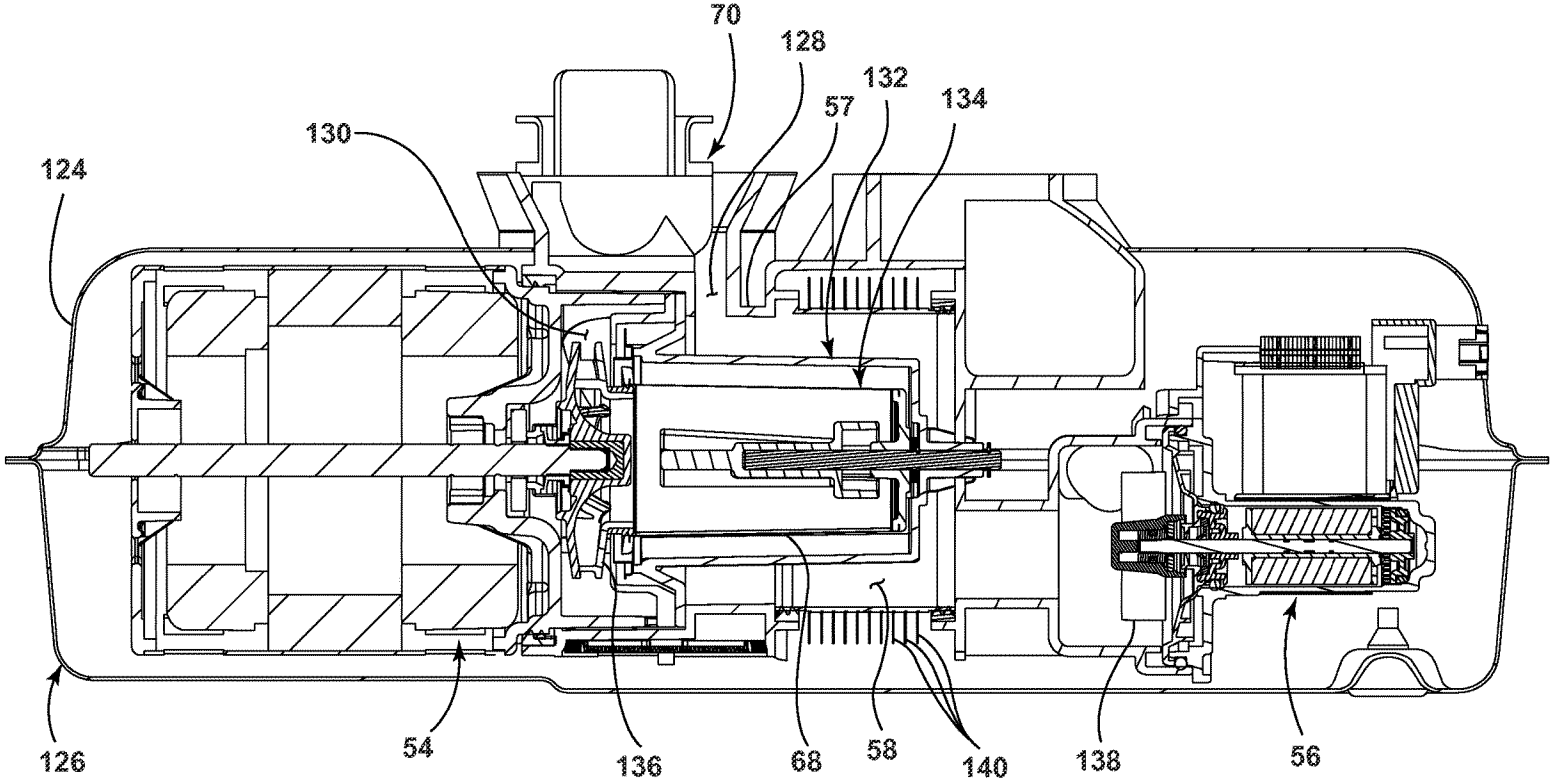
FIG. 5 is a cross-sectional view of the remote sump and filter unit of FIG. 4.

Referring to FIG. 5, a fine screen filter 68 may be fluidly coupled to the recirculation circuit 42 to filter liquid passing through the recirculation circuit 42. More specifically, the fine screen filter 68 may be located in the housing 57 and fluidly disposed between the housing inlet 128 and housing outlet 130 to filter liquid passing through the sump 58. Because the housing 57 is located within the cabinet 12 but physically remote from the wash tub 14, the fine screen filter 68 is not directly exposed to the wash tub 14. In this manner, the housing 57 and fine screen filter 68 may be thought of as defining a filter unit, which is separate and remote from the wash tub 14. The fine screen filter 68 may be a fine filter, which may be utilized to remove smaller particles from the liquid. The fine screen filter 68 may be a rotating filter that is rotatable within the sump 58. Such a rotating filter may utilize a shroud 132 and a first diverter 134 to aid in keeping the fine screen filter 68 clean, such a rotating fine screen filter 68 and additional elements such as the shroud 132 and diverter 134 are set forth in detail in U.S. patent application Ser. No. 13/483,254, filed May 30, 2012, and titled "Rotating Filter for a Dishwasher," which is incorporated herein by reference in its entirety. The rotating filter according to U.S. patent application Ser. No. 13/483,254 may be operably coupled to an impeller 136 of the recirculation pump 54 such that when the impeller 136 rotates the fine screen filter 68 is also rotated.

The drain pump 56 may also be fluidly coupled to the housing 57. The drain pump 56 includes an impeller 138 which may draw liquid from the housing 57 and pump it through a drain pump outlet 62 to a household drain 64 (FIG. 2). The fine screen filter 68 is not fluidly disposed between the housing inlet 128 and the drain pump outlet 62 such that unfiltered liquid may be removed from the sump 58.

A heater 140 may be thermally coupled to the recirculation circuit 42 to heat liquid passing through the recirculation circuit 42. In the illustrated example, the heater 140 is thermally coupled to the sump 58 to heat the liquid passing through the sump 58. Further, the housing 57 has been illustrated as being located inside a portion of the air supply system 40 and the heater 140 may be operably coupled to the controller 112 and may be positioned such that it is mounted to the housing 57 and shared by the liquid recirculation system 38 and the remote sump and filter unit 44. Such that the heater 140 may be configured to heat air in the air supply system 40 and the liquid in the recirculation circuit 42. More specifically, it has been illustrated that the heater 140 is mounted to an exterior of the housing 57 where the air supply system 40 wraps around the housing 57. In this location, the heater 140 may provide heated air and heated liquid into the wash tub 14 at the same time or may provide heated air and heated liquid into the wash tub 14 separately. Alternatively, it has been contemplated that the heater 140 may be mounted to an interior of the housing 57 or that portions of the heater 140 could be mounted on both the interior and the exterior of the housing 57. Any suitable heater may be used for the heater 140 including a coiled heater, multiple ring heater, or a film heater mounted on the housing 57, which has been illustrated by way of example.

While all three of the sump 58, fine screen filter 68, and heater 140 have been illustrated as being located exteriorly of the treating chamber 16 it is contemplated that one or more may be located in the treating chamber 16 including in the bottom area of the tub 14. For example, at least two of the sump 58, fine screen filter 68, and heater 140 may be located exteriorly of the treating chamber 16 while the third is located inside the treating chamber 16. Regardless of which of the above may or may not be located exteriorly of the treating chamber 16 it will be understood that the placement of the at least one of the sump 58, fine screen filter 68, and heater 140 exteriorly of the treating chamber 16 may free up at least a portion of the bottom wall 20 of the tub 14 for placement of the disk sprayers 34.

During operation of the dishwasher 10, the liquid recirculation system 38 may be employed to provide liquid to one or more of the disk sprayers 34 and/or spray assemblies 46-50. Liquid in the wash tub 14 passes into the housing 57 where it may collect in the sump 58. At an appropriate time during the cycle of operation to spray liquid into the treating chamber 16, the controller 112 signals the recirculation pump 54 to supply liquid to one or more of the disk sprayers 34 and/or spray assemblies 46-50. The recirculation pump 54 draws liquid from the sump 58 through the fine screen filter 68 and the recirculation pump 54 where it may then be delivered to one or more of the disk sprayers 34 and/or spray assemblies 46-50 through the liquid diverter 70, the supply tube(s) 52, and any other associated valving or diverters.

Regardless of whether the air is heated or not, the blower 80 may force air into the wash tub 14. The air travels upward within the treating chamber 16 and exits the treating chamber 16 through the vent 94 or is removed from the treating chamber 16 via air return conduit 86. The blower 80 may draw in air from the air return conduit 86 and/or the inlet 90 depending upon the position of the blower shutter 92. More specifically, the position of the blower shutter 92 controls the ratio of ambient air from the inlet 90 and recirculated air from the air return conduit 86. The blower shutter 92 may be positionable to entirely close off the inlets 90 such that no ambient air is allowed to enter the treating chamber 16. More specifically openings of the blower shutter may be aligned or partially aligned with openings of the inlet 90 to allow ambient air to be provided to the treating chamber 16. Activation of the motor 102 of the drive system 100 by the controller 112 moves the cam mechanism 176, which in turn causes movement of the blower shutter 92. In this manner, the output from the single motor 102 effects movement of the blower shutter 92. After achieving the desired ratio of ambient to recirculated air, the motor 102 may be deactivated so that ratio may be maintained. It has been contemplated that the air supply system 40 may be operated while the liquid recirculation system 38 is also being operated. It has also been contemplated that the air supply system 40 may be operated separately to form a drying portion of the operational cycle.

Figure 7:
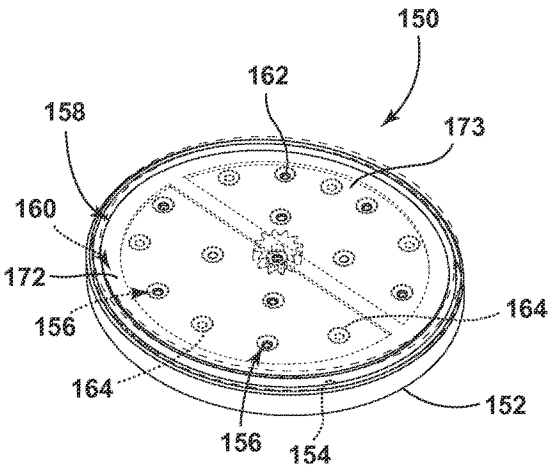
FIG. 7 is a top view of the sprayer of FIG. 6.
Figure 6:
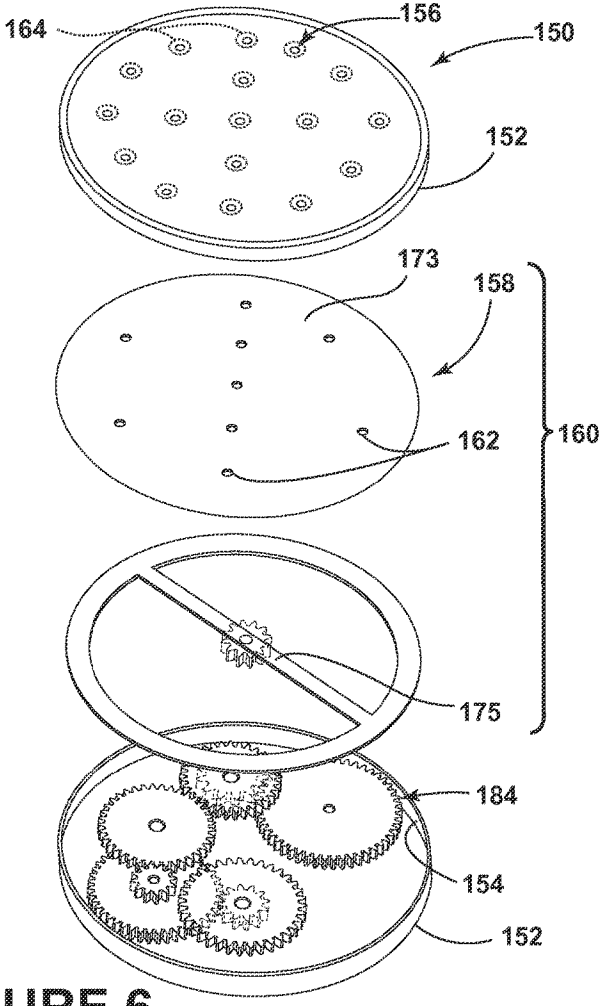
FIG. 6 is an exploded view of a disk sprayer, which may be used in the dishwasher of FIG. 1 according to a second embodiment.

FIGS. 6 and 7 illustrate one exemplary embodiment of a disk sprayer according to a second embodiment of the invention. The disk sprayer 150 is similar to the disk sprayer 34 previously described with it being understood that the description of the like parts applies to the second embodiment, unless otherwise noted. In the exemplary embodiment the disk sprayer 150 is of a variety that is fixed relative to the bottom wall 20 of the tub 14.

In the exemplary embodiment, the disk sprayer 150 includes a body 152 that defines an interior 154, which may be fluidly coupled to the recirculation circuit 42 and having openings 156. A valve body 158 may be located within the interior 154 and may be operable to selectively fluidly couple at least some of the openings 156 to the recirculation circuit 42. As the disk sprayer 150 is fixed relative to the bottom wall 20 of the tub 14, the valve body 158 may be reciprocally moveable within the body 152. In the case where the disk sprayer 150 is moveable relative to the bottom wall 20 the valve body 158 may be fixed.

A plurality of optional sealing rings 164 may be provided along the interior of the body 152, with one of the sealing rings 164 surrounding each of the openings 156. The sealing ring 164 may allow an opening 162 in the valve body 158 to fluidly couple with the opening 156 so long as the opening 162 is at least partially within the sealing ring 164. In this manner, the sealing ring 164 creates a larger effective outlet and allows for a longer fluid communication between the opening 156 having the sealing ring 164 and the opening 162 in the valve body 158. Such sealing rings are set forth in detail in U.S. patent application Ser. No. 13/570,511, filed Aug. 9, 2012, and titled "Dishwasher with Spray System," which is incorporated herein by reference in its entirety. It is also contemplated that alternatively, the sealing ring could be included on the valve body 158 around an opening 162 and that this may also allow the opening 162 to fluidly couple with the opening 156 so long as the opening 156 is at least partially within the sealing ring surrounding the opening 162.

The valve body 158 has been illustrated as including a slidable rotatable plate 160 in the form of a frame 175 supporting a membrane 173. The membrane 173 may be supported or operably coupled to the frame 175 in any suitable manner. The membrane 173 may include the one or more openings 162, which may be in fluid communication with the recirculation circuit 42. A drive system 184 may be operably coupled to the valve body 158 to allow the membrane 173 to be moved while still allowing the membrane 173 to conform to the sealing rings 164. Such an exemplary valve body 158 and drive system as well as alternative valve bodies and drive systems are set forth in detail in U.S. patent application Ser. No. 13/570,577, filed Aug. 9, 2012, and titled "Dishwasher with Sprayer," which is incorporated herein by reference in its entirety.

During operation, the drive system 184 may move the membrane 173 relative to the body 152 of the disk sprayer 150. Such movement, as illustrated, will be a relative rotation between the membrane 173 and the body 152. However, the movement of the valve body 158 with respect to the body 152 may include sliding. Sliding may also refer to a movement between the valve body 158 and the body 152 that may include rotation as well as being slid. The movement may be unidirectional or may be reciprocating.

In the illustrated example, the disk sprayer 150 includes multiple openings 156 and the membrane 173 has multiple openings 162, which are fewer in number than the multiple openings 156. Relative movement of the membrane 173 and the disk sprayer 150 may selectively align the openings 162 with a subset of the multiple openings 156 in the disk sprayer 150 and liquid may spray from such openings 156.

Figure 8:
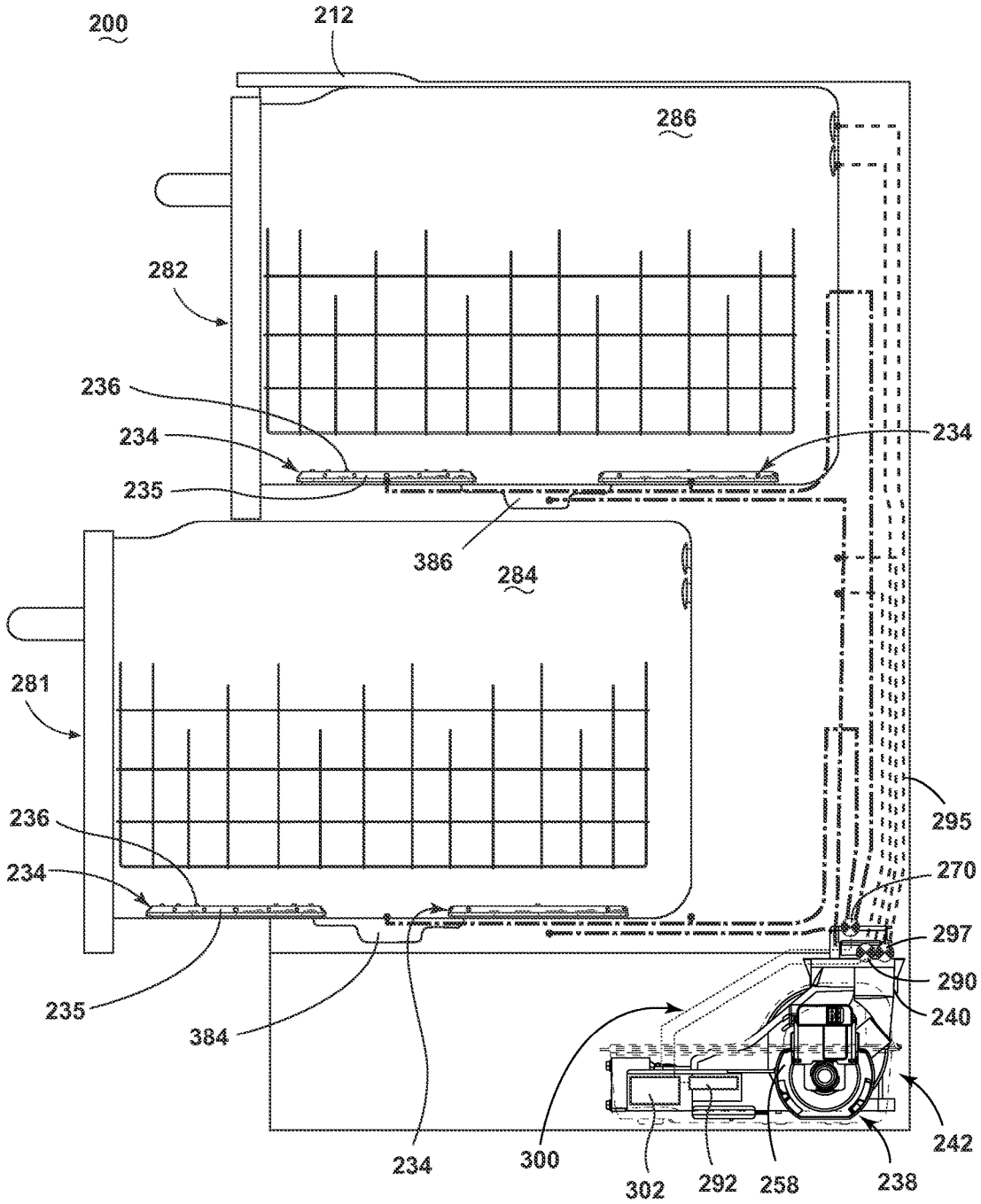
FIG. 8 is a cross-sectional view of a portion of a dishwasher in accordance with a third embodiment of the invention.

FIG. 8 illustrates a third embodiment of the invention wherein a remote sump and filter unit 242 is illustrated as being located in a multi-compartment dishwasher 200 having a first compartment or tub 281 and a second compartment or tub 282. In this embodiment, the tubs 281, 282 each partially define a treating chamber 284, 286, respectively. The first and second tubs 281, 282 are moveable elements and take the form of slide-out drawer units of similar size, each having a handle for facilitating movement of the first and second tubs 281, 282 between an open and closed position. The tubs 281, 282 are slidably mounted to a chassis 212 through a pair of extendible support guides (not shown). The upper compartment 282 is illustrated in the closed position and the lower compartment 281 is illustrated in a partially open position. Notably, the remote sump and filter unit 242 is not carried by either drawer and is illustrated as being positioned in the lower-rear portion of the chassis 212.

As with the previously described embodiments, the dishwasher 200 includes a liquid recirculation system 238 selectively fluidly coupled to first treating chamber 284 and the second treating chamber 286 to selectively supply liquid thereto and form a recirculation flow path. A liquid diverter 270 is provided within the recirculation flow path for selectively directing liquid to at least one of the first treating chamber 284 and the second treating chamber 286. The liquid diverter 270 may be any suitable liquid diverter including a hemispherical seal having a single opening as previously described with respect to the second embodiment above. The liquid diverter is configured to include in the recirculation flow path at least one of the tubs. It is also illustrated that both of the first and second tubs 281, 282 may include multiple disk sprayers 234 and that the liquid diverter may be configured to include in the recirculation flow path at least one of the multiple disk sprayers 234. As with the previous embodiments the disk sprayers 234 may be either rotatable or fixed along the bottom walls of the tubs 281 and 282. The disk sprayers 234 may be designed to move with the first and second tubs 281, 282.

It should be noted that each of the first and second tubs 281, 282 have separate liquid inlets leading to the multiple disk sprayers 234 and separate liquid outlets 384 and 386. The liquid inlets 380 and 382 and outlets 384 and 386 are fluidly coupled to the remote sump and filter unit 242 through the recirculation system 238. The remote sump and filter unit 242 includes a housing 257 defining a sump 258 that is physically separate from both of the first and second tubs 281, 282. The sump 258 may receive liquid sprayed into the first treating chamber 284 and the second treating chamber 286. The housing 257 has an inlet 328 fluidly connected to the liquid outlets 384 and 386 when the first and second tubs 281, 282 are in the closed position and an outlet 330, selectively fluidly coupled to the disk sprayers 234 through the liquid diverter 270 when the first and second tubs 281, 282 are in the closed position to define a recirculation path for the sprayed liquid. Additional valving (not shown) may be included to direct the liquid to a specific disk sprayer 234. The remote sump and filter unit 242 may include a drain pump (not shown) and controller 310, as well as a filter unit (not shown) located within the sump 258 and remote from the first and second tubs 281, 282, and other components like the embodiments disclosed above.

An air supply system 240 may selectively fluidly couple to at least one of the first treating chamber 284 and the second treating chamber 286 to selectively supply air thereto. A second diverter 290 for selectively directing air to at least one of the first treating chamber 284 and the second treating chamber 286 may also be included in the dishwasher 200. An air return system 295 has also been illustrated and may include one or more diverters, schematically illustrated as 297. As with the earlier embodiments the air supply system 240 may include a blower 280 having a selectively positionable blower shutter 292 for controlling a ratio of air from the air return system 295 and an inlet open to ambient air.

Figure 9:
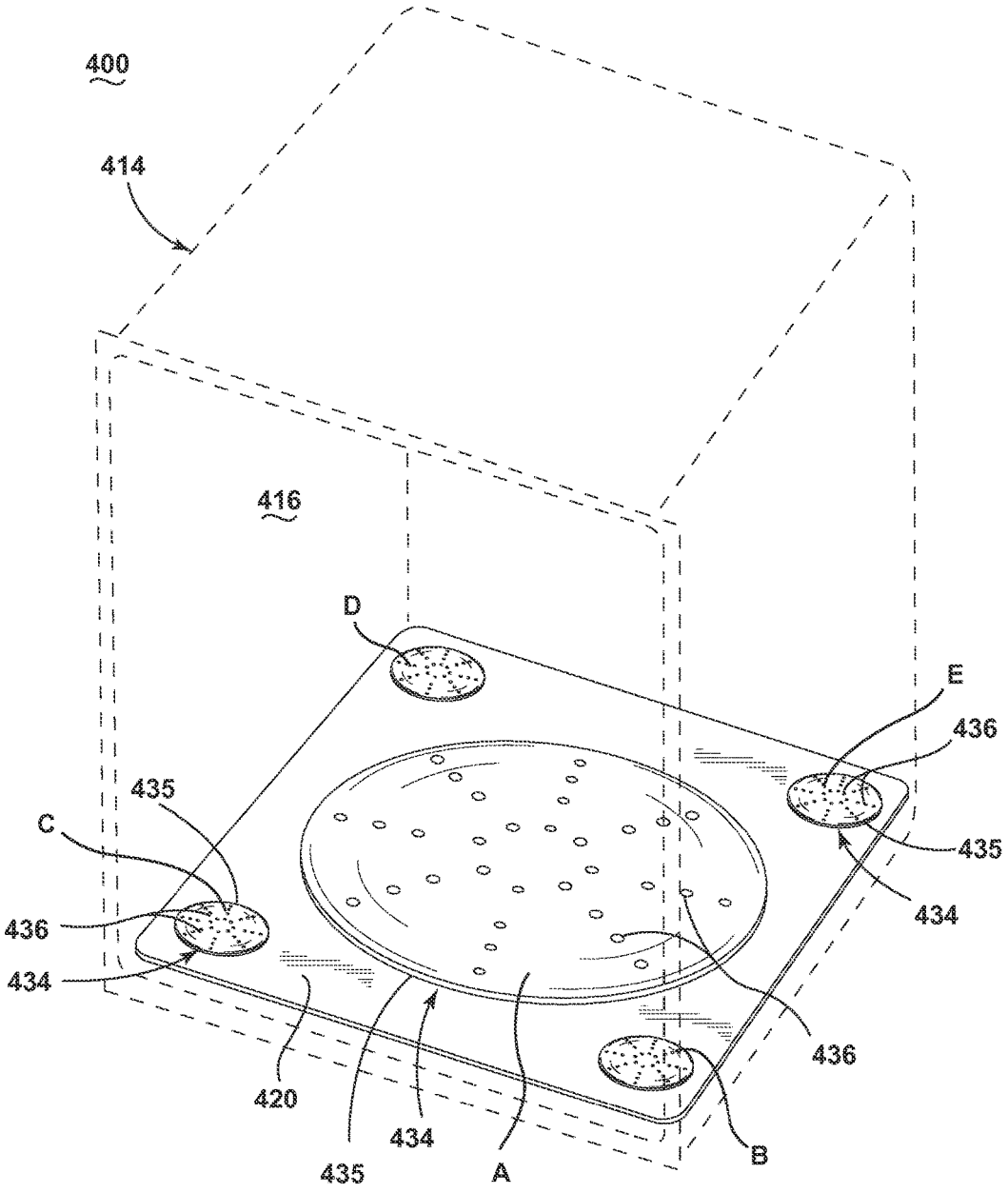
FIG. 9 is a perspective view of a lower portion of a dishwasher in accordance with a fourth embodiment of the invention.

FIG. 9 illustrates alternative disk sprayers 434 according to a fourth embodiment of the invention. The alternative disk sprayers 434 are similar to the disk sprayers 34 previously described and therefore, like parts will be identified with like numerals increased by 400, with it being understood that the description of the like parts of the disk sprayers 34 apply to the disk sprayers 434, unless otherwise noted.

One difference is that the disk sprayers 434 include disk sprayers of different sizes. More specifically, a large disk sprayer 434 is used in combination with small disk sprayers 434. For example, the disk sprayers 434 are illustrated as including one large disk sprayer denoted with an A. Further, several smaller disk sprayers denoted with B, C, D, and E are also shown. The bottom wall 420 is a polygonal with at least four corners, and the four small disks sprayers B, C, D, and E are arranged one-per-corner on the bottom wall 420. It will be understood that the multiple sized disk sprayers 434 may be sized and arranged in any suitable manner. The multiple sized disk sprayers 434 may also take up any amount of the total area of the bottom wall 420.

Figure 10:
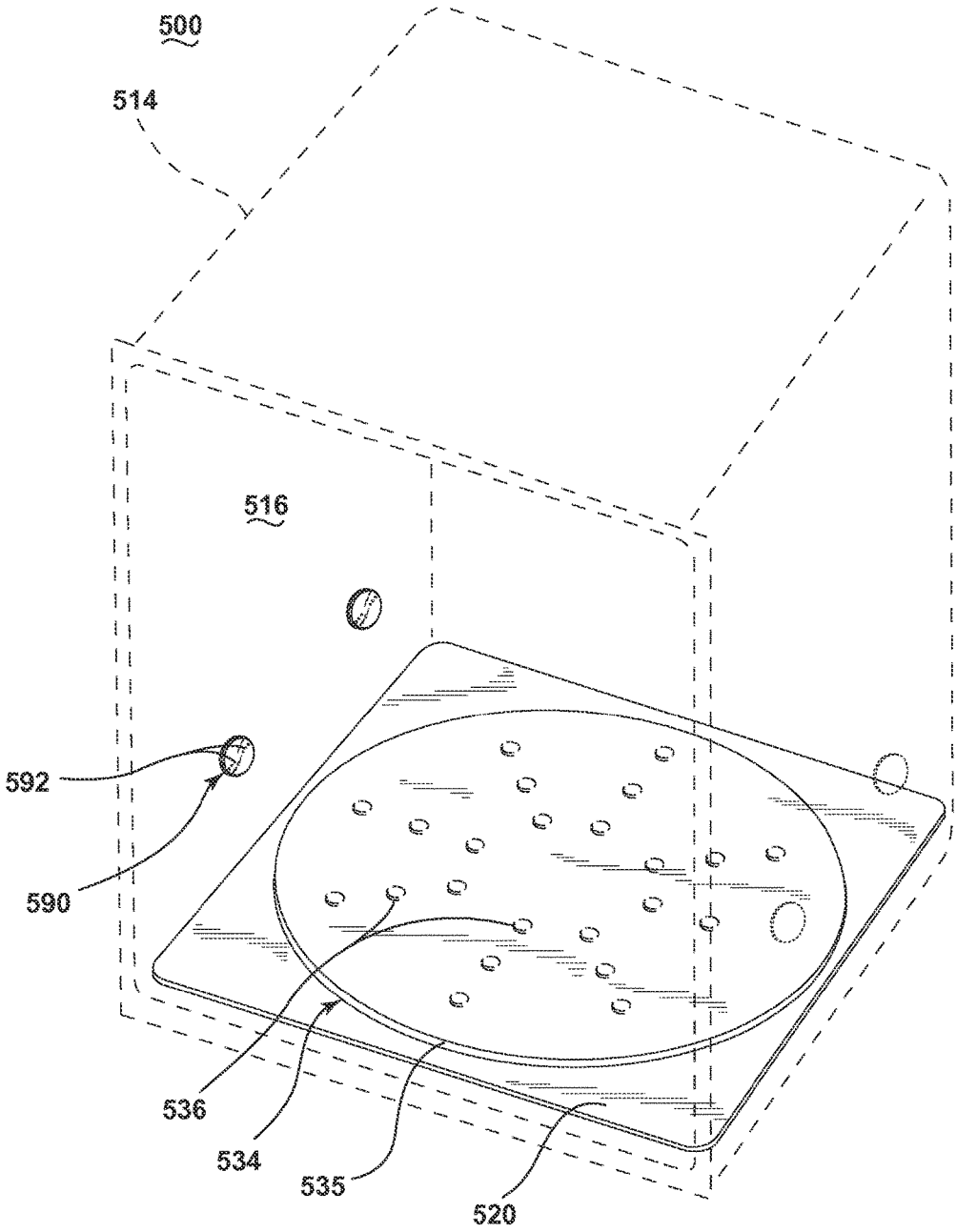
FIG. 10 is a perspective view of a lower portion of a dishwasher in accordance with a fifth embodiment of the invention.

FIG. 10 illustrates an alternative dishwasher 500 with a disk sprayer 534 according to a fifth embodiment of the invention. The alternative dishwasher 500 and disk sprayer 534 are similar to the dishwasher 400 and the disk sprayer 434 previously described and therefore, like parts will be identified with like numerals increased by 100, with it being understood that the description of the like parts of the dishwasher 400 and disk sprayer 434 apply to the dishwasher 500 and disk sprayer 534, unless otherwise noted.

One difference is that the disk sprayer 534 includes one large disk sprayer 534 having a circular planform. The at least one large disk sprayer 534 is centered relative to the bottom wall 520. The large disk sprayer 534 may be shaped and sized in any suitable manner including that it may have a diameter substantially equal to a diameter of the bottom wall 520. It will also be understood that the large disk sprayer 534 may be located in any suitable location of the bottom wall 520 including that the large disk sprayer 534 may be offset in the bottom wall 520. Another difference is that side disk sprayers 590 having openings 592 have been incorporated and may be fluidly coupled with the recirculation circuit 42 to spray liquid into the treating chamber 516. These side disk sprayers 590 may be very similar to the disk sprayers previously described above except that they are mounted on a side wall of the tub 514.

Figure 11:
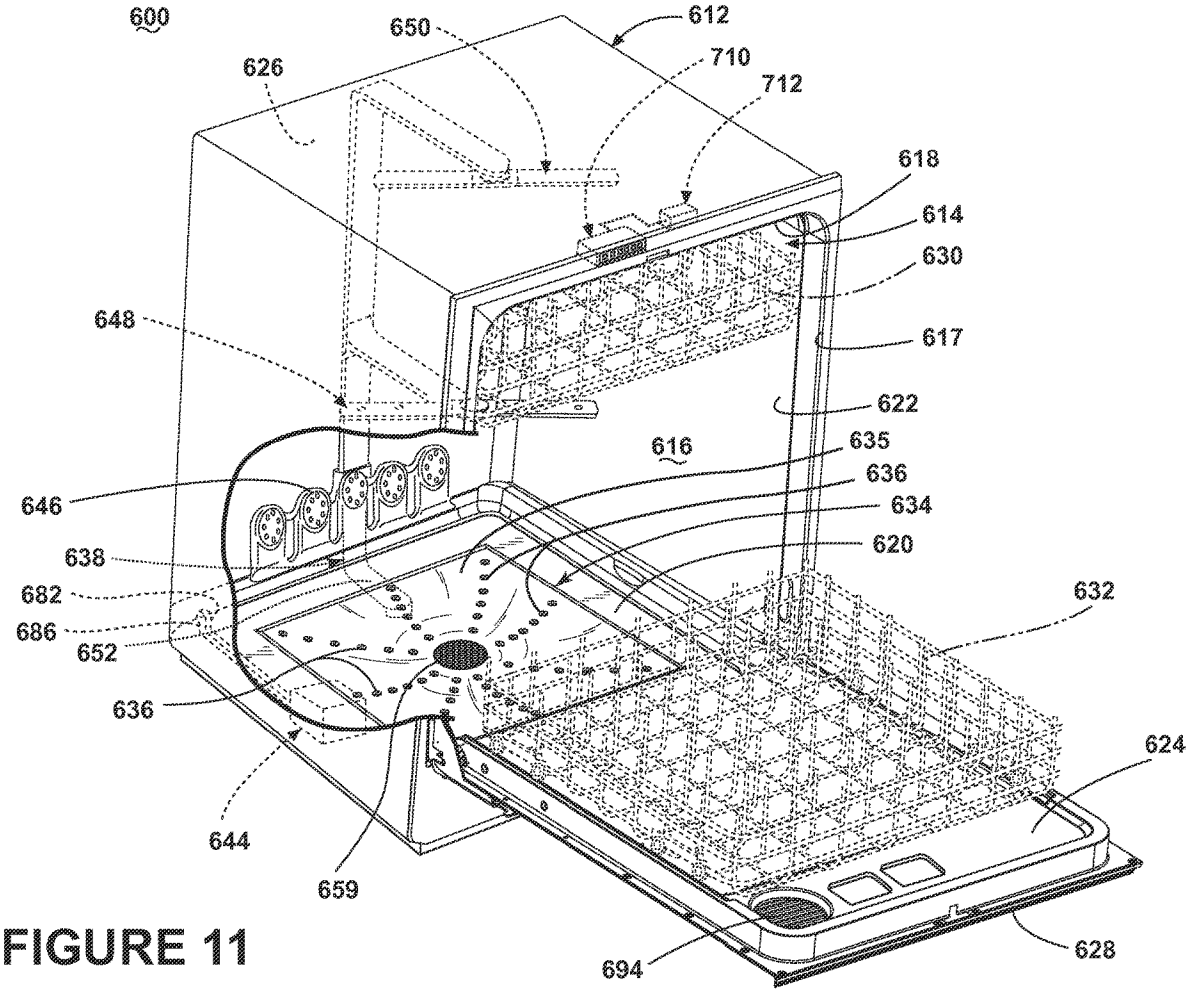
FIG. 11 is a perspective view of a dishwasher in accordance with a sixth embodiment of the invention.

FIG. 11 illustrates an alternative dishwasher 600 according to a sixth embodiment of the invention. The alternative dishwasher 600 is similar to the dishwasher 10 previously described and therefore, like parts will be identified with like numerals increased by 600, with it being understood that the description of the like parts of the dishwasher 10 apply to the dishwasher 600, unless otherwise noted.

Figure 12:
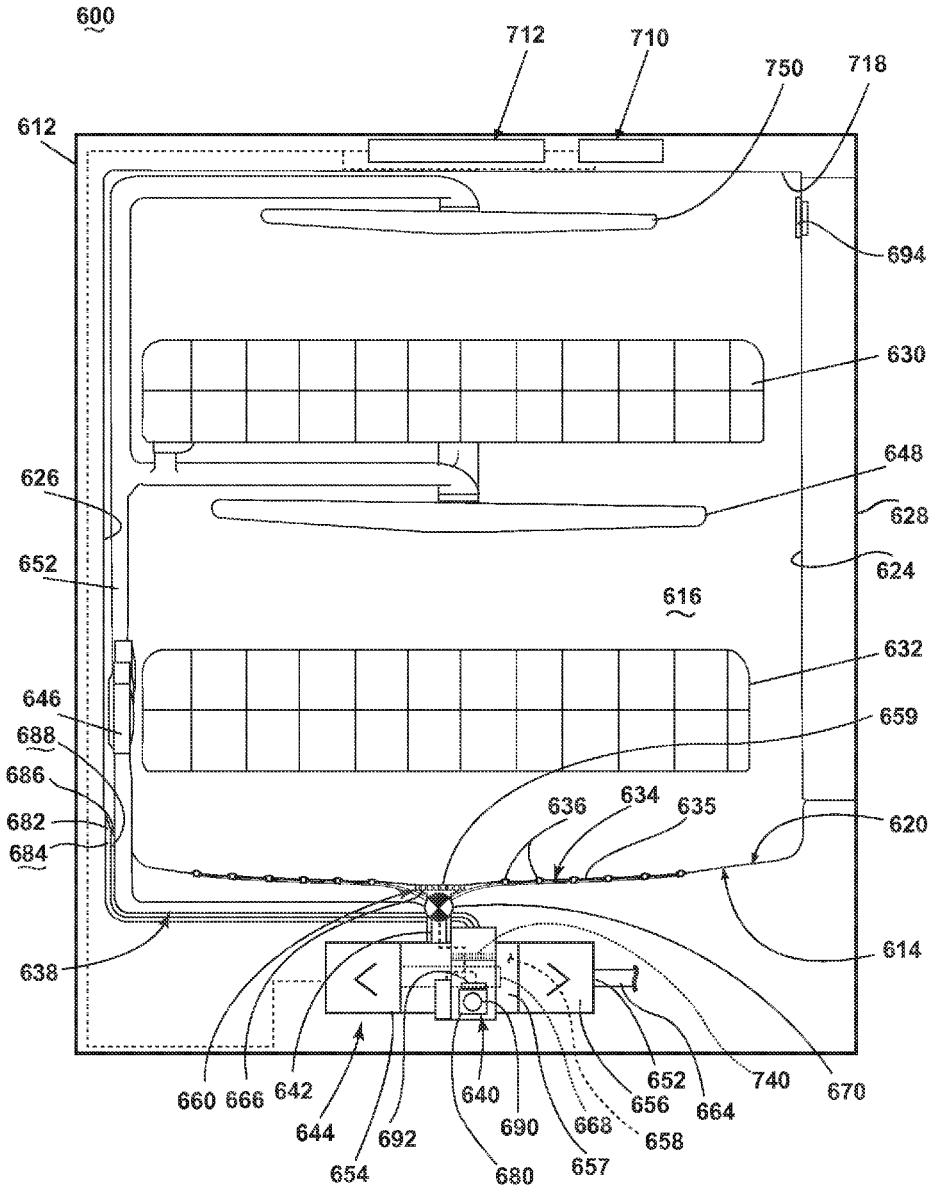
FIG. 12 is a partial schematic cross-sectional view of the dishwasher shown in FIG. 11.

One difference is that the sprayer 634 is a non-disk sprayer; instead, the sprayer 634 has been illustrated as a non-circular sprayer having a square planform. The sprayer 634 has a low profile shape and is centered relative to the bottom wall 620. Such a low profile may include a vertical cross section that does not prominently extend into the treating chamber 616. As more clearly shown in FIG. 12, the sprayer 634 has been integrally formed in the bottom wall 620. This allows the sprayer 634 to have a lower profile and simplifies the liquid sealing of the sprayer 634. The sprayer 634 may be recessed relative to the bottom wall 620, this may aid in draining liquid and soils to the recirculation inlet opening 659. It will be understood that in a non-integrally formed scenario that the sprayer 634 may be as close to the bottom wall 620 as is practically possible with preferably no viewable gap between the sprayer 634 and the bottom wall 620. Alternatively, in a non-integrally formed scenario the sprayer 634 may be recessed relative to the bottom wall 620.

The sprayer 634 may have a substantially planar upper surface 635 with at least one opening 636 in the upper surface 635. Alternatively, the upper surface 635 may be contoured to direct liquid and soils away from the openings 636 and towards the recirculation inlet opening 659. Regardless, the recirculation inlet opening 659 may be located at a low portion of the bottom wall 620. The openings 636 may be fluidly coupled with the recirculation circuit 642 to spray liquid into the treating chamber 616. A valve body may be located within the sprayer 634 and may be operable to selectively fluidly couple at least some of the openings 636 to the recirculation circuit 642.

It will be understood that any suitable sprayers may be used within the dishwashers described above. Regardless of where the sprayer is within the treating chamber, preferably the sprayer may be thin and have a low profile to increase the useable space within the treating chamber for dishes. Further, while a circular planform and a square planform have been specifically illustrated above it will be understood that the term sprayer may include any type of sprayer having any suitable shape or planform including that the sprayer may have an irregular shape.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

The embodiments of the invention described above allow for a variety of benefits including that the disk sprayers provide for additional coverage of the treating chamber. The disk sprayers may also increase the velocity of the spray emitted from the openings in the disk sprayer while not sacrificing coverage or individual nozzle size. Further, with less liquid flow needed, a smaller recirculation pump having a smaller motor may also be used which may result in a cost and energy savings. The second embodiment, which include the membrane, allow for the outlets to be sealed such that liquid does not leak to outlets that are not intentionally being fluidly coupled with the fluid passage. Such sealing challenges may occur for various reasons including because the surface of the valve body or the sprayer are too rough or uneven. The sealing rings provide a smaller sealing surface for the membrane allowing a greater force to be applied to those points and allowing for a better seal. The sealing rings also allow soils, which may pass into the sprayer, to pass under the membrane without running the risk of holding the membrane up, providing a leak path. The flex in the membrane allows it to form around the sealing ring and provide a robust seal.

While the invention has been specifically described in connection with certain specific embodiments thereof, it is to be understood that this is by way of illustration and not of limitation, and the scope of the appended claims should be construed as broadly as the prior art will permit. For example, it has been contemplated that the invention may differ from the configurations shown in FIGS. 1-12, such as by inclusion of other conduits, dish racks, valves, spray assemblies, seals, and the like, to control the flow of liquid and the supply of air.

What is claimed is:

1. A dishwasher for treating dishes according to at least one automatic cycle of operation, comprising:

a tub comprising a lowermost bottom wall for at least partially defining a treating chamber in which dishes may be received for treatment;

at least one sprayer having a body with at least a portion of the body directly provided on the lowermost bottom wall and where the body includes multiple openings on an upper surface of the body through which liquid is emitted into the treating chamber;

a recirculation circuit, with a recirculation inlet located in the lowermost bottom wall, fluidly coupling the treating chamber to the at least one sprayer, such that liquid emitted into the treating chamber from the at least one sprayer may be returned to the recirculation circuit through the recirculation inlet and directed back to the sprayer for recirculation;

a sump located exteriorly of the treating chamber and having a housing that is fluidly coupled to the recirculation circuit and separated from the treating chamber by a conduit such that it cannot be accessed by the treating chamber;

a heater located exteriorly of the sump and thermally coupled to the sump;

an air supply system conduit thermally coupled to the heater and configured to provide air to the treating chamber; and a filter located within the housing of the sump to filter liquid passing through the sump; and wherein a placement of the heater, the filter, and the sump exteriorly of the treating chamber is configured to free the lowermost bottom wall of the tub for placement of the body of the at least one sprayer on the lowermost bottom wall; and wherein the heater is configured to heat at least one of liquid passing through the recirculation circuit or air provided to the treating chamber.

2. The dishwasher of claim 1 wherein the at least one sprayer is integrally formed in the lowermost bottom wall.

3. The dishwasher of claim 1 wherein the at least one sprayer defines a low profile.

4. The dishwasher of claim 1 wherein the at least one sprayer has a substantially planar upper surface, with at least one opening located in the upper surface.

5. The dishwasher of claim 1 wherein the at least one sprayer has a peripheral wall and the upper surface, with at least one opening located in the upper surface.

6. The dishwasher of claim 1 wherein the at least one sprayer has a circular planform.

7. The dishwasher of claim 1 wherein the at least one sprayer is not a disk.

8. The dishwasher of claim 1 wherein the at least one sprayer comprises a rotatable sprayer that is rotatable relative to the lowermost bottom wall.

9. The dishwasher of claim 1 wherein the at least one sprayer comprises a fixed sprayer that is fixed relative to the lowermost bottom wall.

10. The dishwasher of claim 9 wherein the fixed sprayer is integrally formed with the lowermost bottom wall.

11. The dishwasher of claim 1 wherein the body comprises at least one through passage that passes through the body and allows liquid to enter the recirculation inlet.

12. The dishwasher of claim 1 wherein the body is centered relative to the lowermost bottom wall.

13. The dishwasher of claim 1, further comprising a valve body located within the body and configured to selectively fluidly couple at least some of the multiple openings to the recirculation circuit.

14. The dishwasher of claim 1 wherein the filter is a rotating filter.

15. The dishwasher of claim 1 wherein the heater is thermally coupled with at least two faces of the sump housing.

16. The dishwasher of claim 15 wherein the air supply system conduit encloses at least a portion of the heater.

* * * * *